US006163962A

United States Patent [19]

Ganguzza

[11] Patent Number: 6,163,962

[45] Date of Patent: Dec. 26, 2000

[54] CHESTNUT'S FRIEND

[76] Inventor: Philip V. Ganguzza, 2425 Williamsbridge Rd., Apt 4B, Bronx, N.Y. 10469

[21] Appl. No.: 09/154,184

[22] Filed: Sep. 18, 1998

[51] Int. Cl.[7] ..... B26B 17/00

[52] U.S. Cl. ..... 30/120.1; 30/120.2; 30/120.3

[58] Field of Search ..... 30/120.1, 120.2, 30/120.3, 360

[56] References Cited

U.S. PATENT DOCUMENTS

| | | | |
|---|---|---|---|
| 964,414 | 7/1910 | Fort et al. | 30/120.2 |
| 1,094,698 | 4/1914 | Bostrom | 30/120.2 |
| 1,248,313 | 11/1917 | Gradick, Sr. | 30/120.2 |
| 2,804,111 | 8/1957 | Burchett | 30/120.3 |
| 4,128,938 | 12/1978 | Davis | 30/120.3 |
| 5,092,231 | 3/1992 | Smith | 30/120.2 |
| 5,233,747 | 8/1993 | Johnson | 30/120.1 |
| 5,239,918 | 8/1993 | Whaling | 30/120.2 |
| 5,333,384 | 8/1994 | Graves | 30/120.2 |
| 5,399,117 | 3/1995 | Telford | 30/120.1 |

*Primary Examiner*—M. Rachuba
*Assistant Examiner*—Omar Flores-Sanchez

[57] ABSTRACT

A tool is used for piercing a chestnut to prevent it from bursting while cooking. The tool includes a base, an inverted U-shaped support, a plunger, a striking knob connected to a top end of the plunger, a bumper on the opposite end of the plunger, and a cutting blades having four cross blades attached to the bumper.

1 Claim, 5 Drawing Sheets

CHESTNUT'S FRIEND

BACKGROUND OF THE INVENTION

The tool disclosed is for piercing chestnuts so as to prevent the chestnut from bursting while cooking.

DETAILED DESCRIPTION OF THE DRAWINGS

Figure 1:
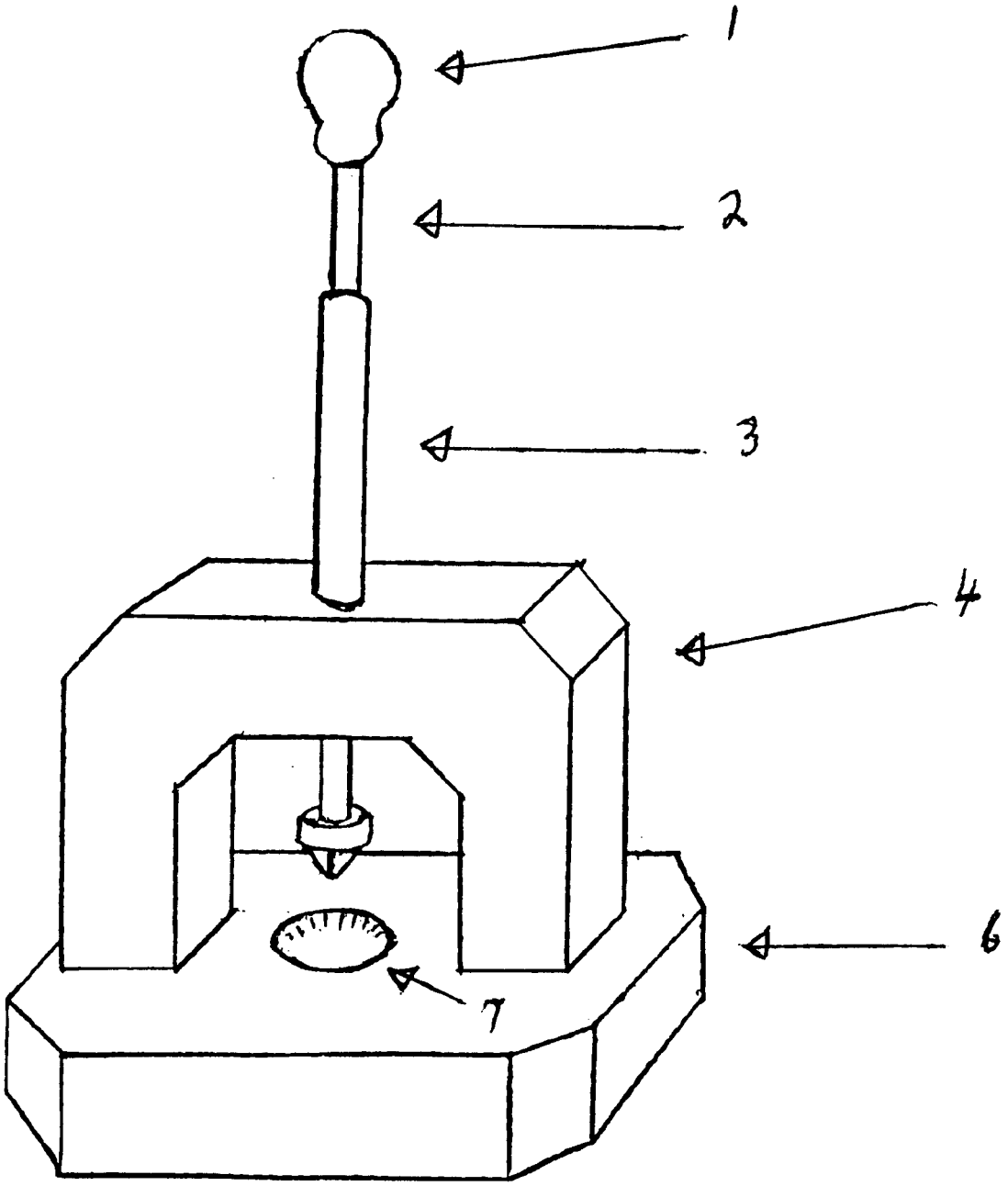
FIG. 1 is a side view of the assembled tool.

The assembled tool, shown in FIG. 1, has a striking knob (1), attached to a plunger shaft (2). The plunger shaft has four cutting blades attached to the end of the shaft opposite the striking knob. The plunger shaft (2) has a sleeve (3) located at a top of an inverted U-shaped support (4). The inverted U-shaped support (4) is connected to a base (6). The base (6) has a well (7) which is a round shaped hole at the center of the top surface of the base for the purpose of supporting the chestnut during piercing.

Figure 2:
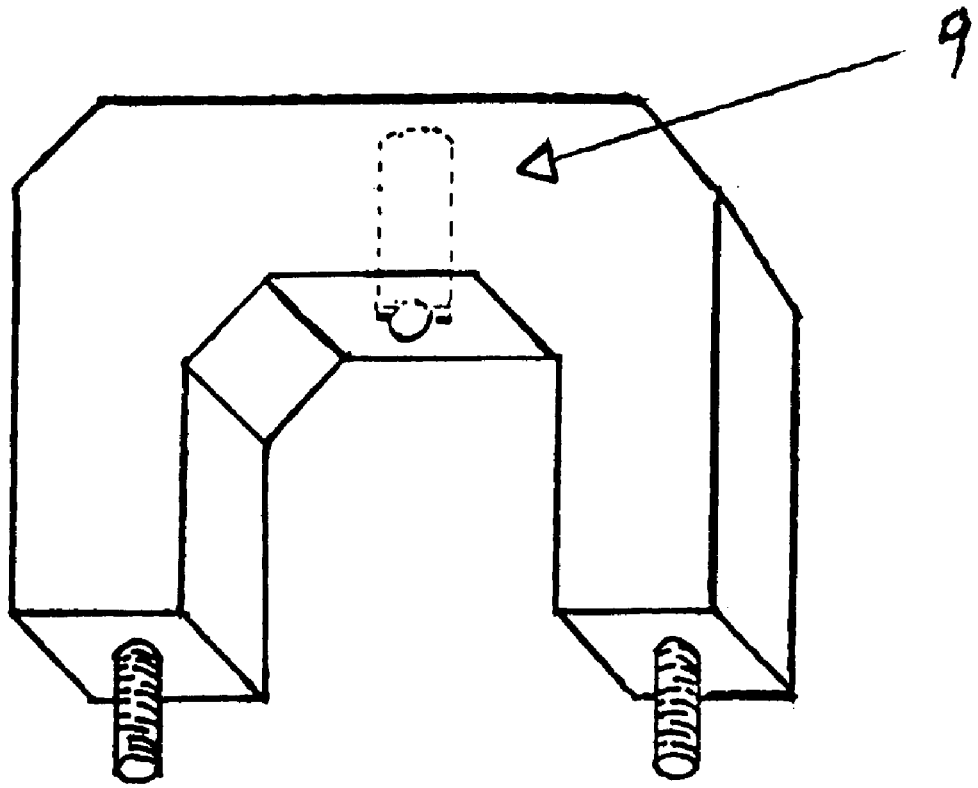
FIG. 2 is an exploded view of the inverted U-shaped support.

Referring to FIG. 2, the inverted U-shaped support has a hole (9) to guide the plunger shaft (2), and a pair of screws attached each one to an end leg of the inverted U-shaped support.

Figure 3A:
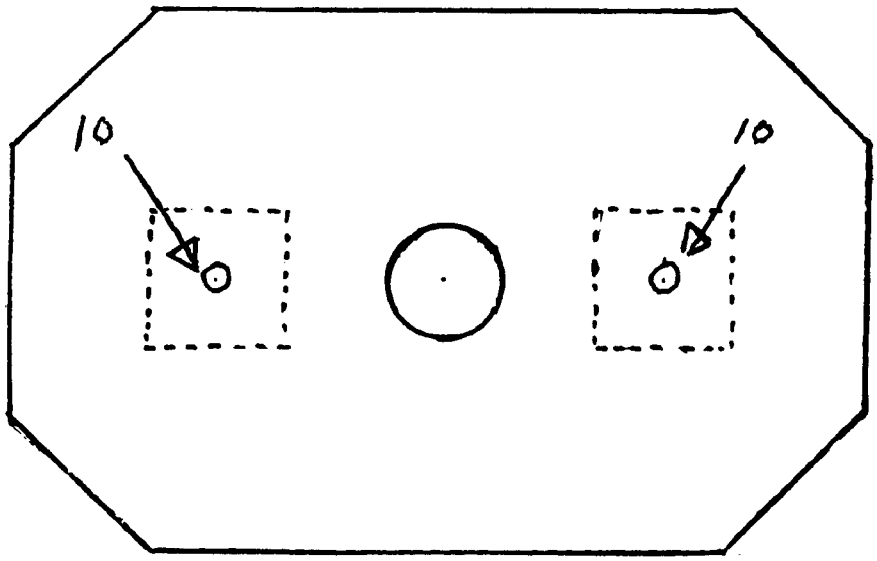
FIG. 3*a* is a top view of the base.
Figure 3B:
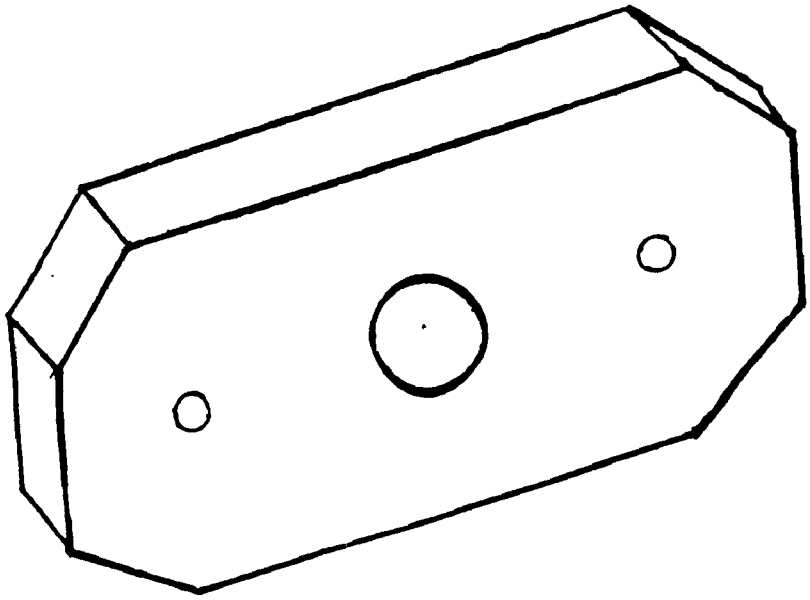
FIG. 3*b* is an isometric view of the base.

FIGS. 3*a* and 3*b* show the base, which has screw openings (10) to engage the screws on the ends of the legs of the inverted U-shaped support, to attach the support to the base.

Figure 4:
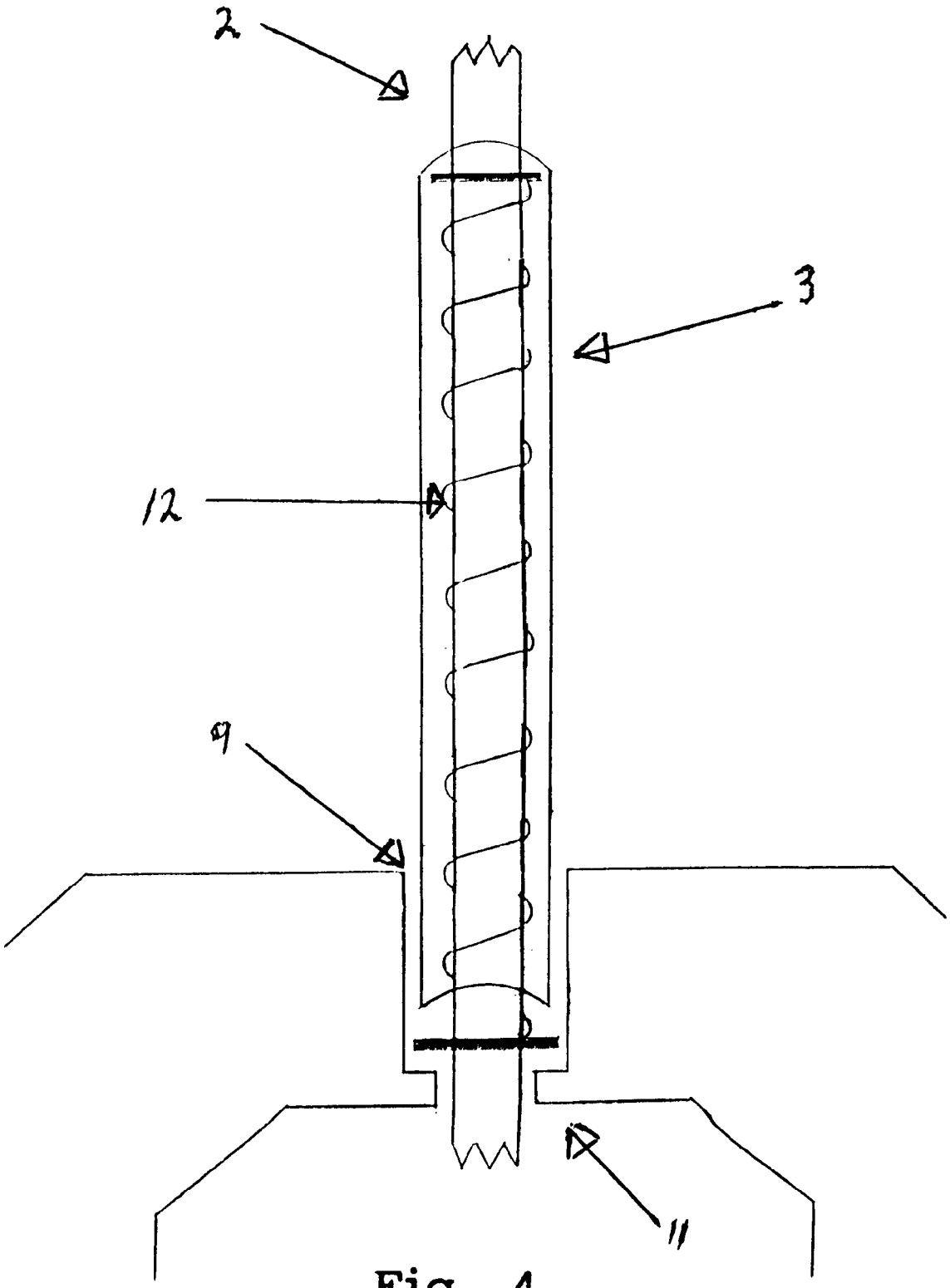
FIG. 4 is a sectional view of the plunger shaft, spring and ledge.

Regarding FIG. 4, the construction of the plunger shaft, sleeve, spring and the upper port of the inverted U-shaped support is shown. The sleeve (3) has one partially closed top end having a hole sized to permit shaft (2) to move within the sleeve. The bottom end of the sleeve is completely open and supported on a ledge (11) formed in the bottom of the hole (9) in the top of the inverted U-shaped support. Inside the sleeve is a spring (12) that moves freely when placed over the plunger shaft. Both ends of the spring are extended wider than the top sleeve opening and the ledge to hold the spring in place and to prevent it from passing through the top sleeve opening or the hole in the top of the inverted U-shaped support.

Figure 5A:
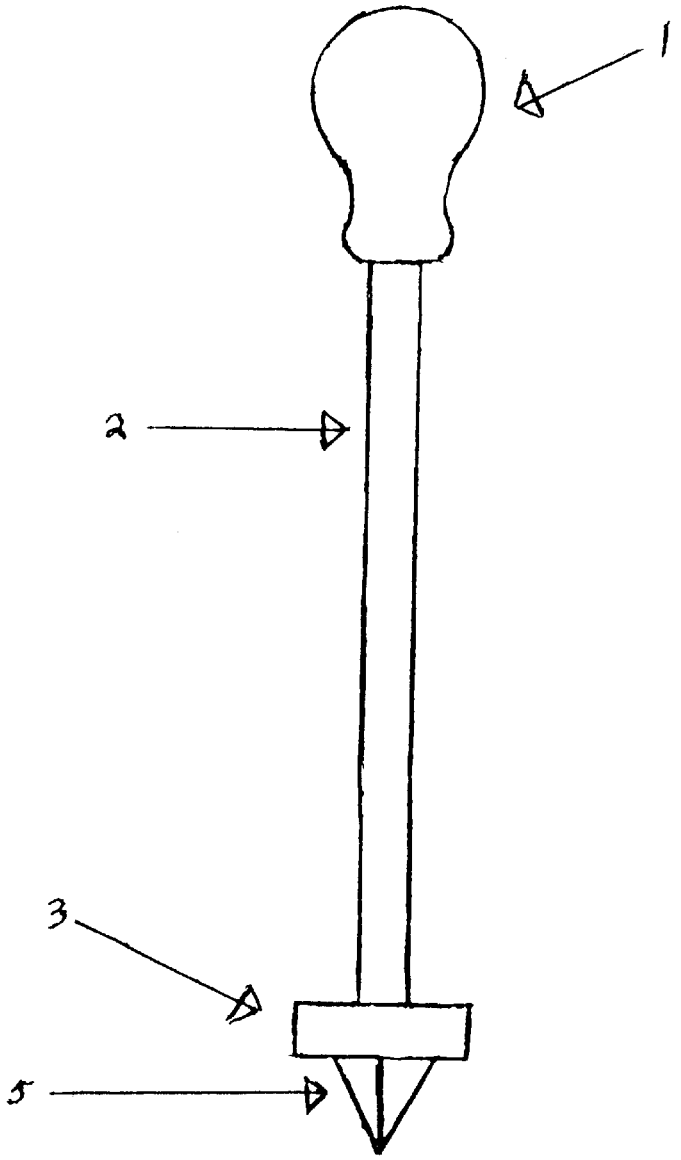
FIG. 5*a* a is a view of the assembled plunger with striking knob and piercing end.
Figure 5B:
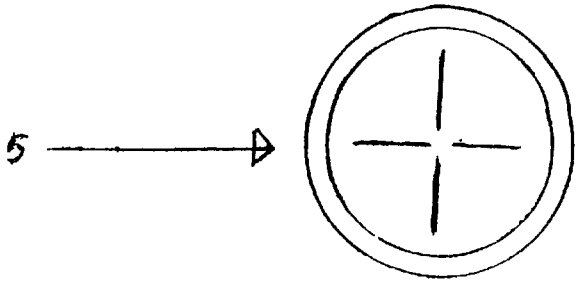
FIG. 5*b* is an end view of the piercing blades.

FIGS. 5*a* and 5*b* illustrate the striking knob (1) connected to one end of the shaft (2) and bumper (3) on the other end of the shaft. Four cross blades (5) are attached to one end of the bumper (3) at a position collinear with the shaft.

To operate the tool, a chestnut is placed in the well (7). The plunger is pushed down by the operator, against the force of the spring. The blades cut into the skin of the chestnut, to pierce it, so that the chestnut will not burst during roasting.

What is claimed is:

1. A tool comprising:

a base, an inverted U-shaped support attached to the base, a plunger mounted in the inverted U-shaped support, and cutting blades attached to an end of the plunger which faces the base;

the base comprising:

a top surface, a bottom surface, and a front surface;

a round shaped well at the center top surface;

and two screw openings collinear to the well;

the inverted U-shaped support comprising:

a top section;

a hole positioned in the top section;

a screw connected at the bottom of each one of a leg of the inverted U-shaped support; and a ledge formed at the bottom of the hole positioned in the top section;

the inverted U-shaped support attached to the base by the screws connecting with the screw holes in the base;

the plunger comprising:

a shaft;

a sleeve, the shaft fitting into the sleeve, the shaft free to move in the sleeve;

the sleeve having a partially closed opening in a top end; and being completely open at a bottom end;

a spring, the spring fitting around the shaft, and located in the sleeve;

a striking knob connected to a top end of the shaft;

and a bumper on the end of the shaft opposite the striking knob;

the cutting blades comprising:

four cross blades attached to the bumper, positioned to face the well in the base of the tool;

wherein when a chestnut is placed in the well, the tool operator pushes on the plunger against the bias of the spring and transfers the pushing force through the shaft to the blades to pierce the chestnut and prevent it from bursting while roasting.

* * * * *